US011498070B2

(12) United States Patent
Lee et al.

(10) Patent No.: US 11,498,070 B2
(45) Date of Patent: Nov. 15, 2022

(54) MICROFLUIDIC DEVICES WITH TUNABLE WETTABILITY AND SOLVENT RESISTANCE AND METHODS FOR MANUFACTURING THE SAME

(71) Applicant: THE TRUSTEES OF THE UNIVERSITY OF PENNSYLVANIA, Philadelphia, PA (US)

(72) Inventors: Daeyeon Lee, Wynnewood, PA (US); David Issadore, Philadelphia, PA (US); Sagar Prasad Yadavali, Philadelphia, PA (US); Heon-Ho Jeong, Philadelphia, PA (US)

(73) Assignee: The Trustees of the University of Pennsylvania, Philadelphia, PA (US)

( * ) Notice: Subject to any disclaimer, the term of this patent is extended or adjusted under 35 U.S.C. 154(b) by 30 days.

(21) Appl. No.: 17/040,120

(22) PCT Filed: Mar. 21, 2019

(86) PCT No.: PCT/US2019/023289
§ 371 (c)(1),
(2) Date: Sep. 22, 2020

(87) PCT Pub. No.: WO2019/183303
PCT Pub. Date: Sep. 26, 2019

(65) Prior Publication Data

US 2021/0023559 A1 Jan. 28, 2021

Related U.S. Application Data

(60) Provisional application No. 62/647,131, filed on Mar. 23, 2018.

(51) Int. Cl.
*B01L 3/00* (2006.01)

(52) U.S. Cl.
CPC ... *B01L 3/502761* (2013.01); *B01L 3/502707* (2013.01); *B01L 3/502784* (2013.01); *B01L 2300/0867* (2013.01); *B01L 2300/165* (2013.01)

(58) Field of Classification Search
CPC ..... B01L 3/502761; B01L 3/502707; B01L 3/502784; B01L 2300/0867;
(Continued)

(56) References Cited

U.S. PATENT DOCUMENTS

2009/0053471 A1* 2/2009 Hamedi ..... B01L 3/5027 428/156
2013/0309679 A1 11/2013 Ismagilov et al.
(Continued)

FOREIGN PATENT DOCUMENTS

WO WO-2007117107 A1 * 10/2007 ..... H01L 21/0271
WO 2016/145050 A1 9/2016
(Continued)

OTHER PUBLICATIONS

Jeong et al (Kilo-scale droplet generation in three-dimensional monolithic elastomer device, Lab of a Chip, 2015, vol. 15, pp. 4387-4392 (Year: 2015).*
(Continued)

*Primary Examiner* — Benjamin R Whatley
*Assistant Examiner* — Jean Caraballo-Leon
(74) *Attorney, Agent, or Firm* — BakerHostetler

(57) ABSTRACT

Microfluidic devices having a construct formed from perfluoropolyether and poly(ethylene glycol) diacrylate. The construct includes an inlet for receiving a continuous phase fluid, an inlet for receiving a dispersed phase fluid, and a plurality of channels extending through the construct. The plurality of channels are in fluid communication with both the inlet of the continuous phase fluid and the inlet of the
(Continued)

dispersed phase fluid. The construct further includes a plurality of microdroplet generators configured to produce microdroplets, each of the microdroplet generators in fluid communication with the plurality of channels. Additionally, the construct includes an outlet formed in the construct and in fluid connection with the plurality of microdroplet generators.

37 Claims, 20 Drawing Sheets

(58) Field of Classification Search
CPC ..... B01L 2300/165; B01F 23/41; B01F 33/3011; B01F 33/813
See application file for complete search history.

(56) References Cited

U.S. PATENT DOCUMENTS

2017/0199173 A1* 7/2017 Konry ..... B01L 3/502784
2017/0362449 A1 12/2017 Malic et al.

FOREIGN PATENT DOCUMENTS

WO 2017/053678 A1 3/2017
WO 2017/106252 A1 6/2017

OTHER PUBLICATIONS

Hu et al (Optically Transparent, Amphiphilic Networks Based on Blends of Perfluoropolyethers and Poly(ethylene glycol), Journal of the American Chemical Society, 2008, vol. 130, pp. 14244-14252 (Year: 2008).*
Kalakkunnath et al (Viscoelastic Characteristics of UV Polymerized Poly(ethylene glycol) Diacrylate Networks with Varying Extents of Crosslinking, Wiley Interscience, 2006, vol. 44, pp. 2058-2070 (Year: 2006).*
Kang et al (Poly(ethylene glycol) (PEG) Microwells in Microfluidics: Fabrication Methods and Applications, Biochip Journal, 2014, pp. 241-253 (Year: 2014).*

* cited by examiner

MICROFLUIDIC DEVICES WITH TUNABLE WETTABILITY AND SOLVENT RESISTANCE AND METHODS FOR MANUFACTURING THE SAME

CROSS-REFERENCE TO RELATED APPLICATIONS

This application is the National Stage Application of International Patent Application No. PCT/US2019/023289, filed Mar. 21, 2019, which claims priority to and the benefit of U.S. Patent Application No. 62/647,131, "Microfluidic Devices with Tunable Wettability and Solvent Resistance and Methods for Manufacturing the Same" (filed Mar. 23, 2018), the entireties of which applications are incorporated herein by reference for any and all purposes.

GOVERNMENT RIGHTS

This invention was made with government support under Contract No. 5-R21-AI-124057-02 awarded by the National Institutes of Health and Contract No. 1554200 awarded by the National Science Foundation. The government has certain rights in the invention.

TECHNICAL FIELD

This disclosure relates to microfluidic devices having tunable wettability and solvent resistance and methods of manufacturing the same.

BACKGROUND

Microfluidics allows for precise control of flows of fluids at the sub-millimeter scale, which can be harnessed to produce materials with useful functionality and properties. The small scale of microfluidics allows precise control of the balance between surface tension and viscous forces in multiphasic flows, making it possible to generate highly monodisperse droplets. Micrometer-scale droplets and/or emulsions have been utilized for a wide variety of applications including digital biological assays, the generation of functional microparticles, and the on-chip synthesis of nanoparticles.

Microfluidic devices have been designed to produce highly uniform emulsion droplets by tuning the flow and interfacial phenomena of multiphasic fluids. These microfluidic droplets serve as excellent templates to form highly uniform solid microspheres with a variety of shapes and morphology in the size range of sub-micrometers to hundreds of micrometers.

SUMMARY

Aspects of the invention are directed to microfluidic devices having tunable wettability and solvent resistance as well as methods of manufacturing the same. According to one aspect of the invention, provided is a microfluidic device having a construct formed from perfluoropolyether and poly(ethylene glycol) diacrylate. The construct includes an inlet for receiving a continuous phase fluid, an inlet for receiving a dispersed phase fluid, and a plurality of channels extending through the construct. The plurality of channels are in fluid communication with both the inlet of the continuous phase fluid and the inlet of the dispersed phase fluid. The construct further includes a plurality of microdroplet generators configured to produce microdroplets, each of the microdroplet generators in fluid communication with the plurality of channels. Additionally, the construct includes an outlet formed in the construct and in fluid connection with the plurality of microdroplet generators.

In accordance with another aspect, a method is provided for producing a microfluidic device. The method includes forming a first master that has at least a first feature and a second feature, the first feature having a height that is different than a height of the second feature; forming a second master that defines a plurality of channels; and positioning a liquid precursor comprising perfluoropolyether between the first master and the second master.

According to yet a further aspect, another method is provided for producing a microfluidic. The method includes positioning a liquid precursor comprising PFPE and PEGDA between a hard master and a soft master. The hard master and the soft master together defining at least one fluid inlet, at east one fluid outlet, a plurality of microdroplet generators, and a plurality of channels. The method further includes curing the precursor to form a construct.

Also provided are microfluidic devices, comprising: a construct comprising a perfluoroether (PFPE) and a poly (ethylene glycol) acrylate (PEGA), the construct comprising one or more first channels formed in the construct, the one or more first channels being configured to receive a first fluid; one or more second channels formed in the construct, the one or more second channels being configured to receive a second fluid; a third channel formed in the construct, the third channel configured (i) to receive first fluid from the one or more first channels and (ii) to receive second fluid from the one or more second channels, the third channel optionally being configured to effect under suitable conditions formation of an emulsion between the first fluid and the second fluid.

Further provided are methods, comprising: with a device according to the present disclosure, communicating a first fluid though the one or more first channels and communicating a second fluid through the one or more second channels under conditions sufficient to give rise to formation of an emulsion between the first fluid and the second fluid in the third channel.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a nonspecific one or more of the elements, the small letter designation may be dropped. This emphasizes that according to common practice, the various features of the drawings are not drawn to scale unless otherwise indicated. On the contrary, the dimensions of the various features may be expanded or reduced for clarity. Included in the drawings are the following figures.

DETAILED DESCRIPTION OF ILLUSTRATIVE EMBODIMENTS

Aspects of the invention are directed to improved microfluidic devices having tunable wettability and solvent resistance as well as methods of manufacturing the same. The inventors recognized that microdroplets having improved uniformity and homogeneity could be achieved for a vast range of hydrophobic and hydrophilic fluids by microfluidic devices having a wettability tuned to the particular fluids used therein.

The inventors have also recognized that one unsolved challenge in droplet microfluidics has been the lack of a material that can be used to rapidly prototype droplet microfluidic systems that is compatible with the organic solvents necessary for the syntheses of many materials.

Soft lithography-based techniques have been used with success to fabricate microfluidic devices with complex geometry; however, the many material of choice used for device fabrication have poor solvent compatibility, limiting utilization of soft lithography in the preparation of organic solvent-based emulsions.

As used herein, the phrases "continuous phase" and "disperse phase" are used generically to describe the fluid that the droplets and/or microbubbles are contained in and the fluid comprising the droplets and/or microbubbles, respectively.

As used herein, the term "fluid" is not limited to liquid substances, but can include substances in the gaseous phase, such as with, e.g., microbubbles.

Figure 1:
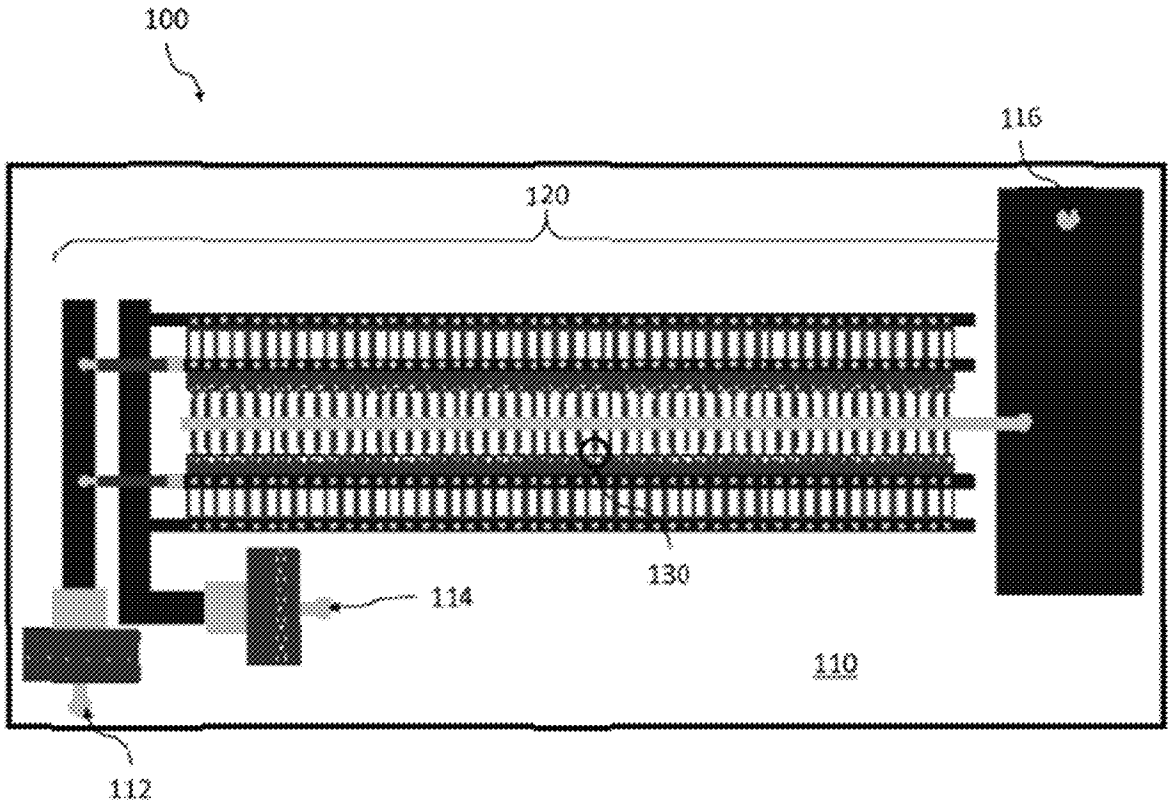
FIG. 1 is a schematic illustration of a microfluidic device in accordance with aspects of the invention.

FIG. 1 is a schematic illustration of a microfluidic device 100 configured for generating microdroplets. As a general overview, microfluidic device 100 includes a construct 110, a continuous phase inlet 112, a dispersed phase inlet 114, a plurality of channels 120, a plurality of microdroplet generators 130, and an outlet 116.

Construct 110 defines one or more inlets (e.g., continuous phase inlet 112 and dispersed phase inlet 114) for receiving the continuous phase flu id and the dispersed phase fluid, and one or more outlets (e.g. outlet 116) for delivering the produced microdroplets. In one embodiment, construct 110 has a single continuous phase inlet 112 and a single dispersed phase inlet 114. In another embodiment, construct 100 includes a single outlet 190.

A plurality of channels 120 extend through construct 100. The plurality of channels 120 is in fluid communication with both the continuous phase inlet 112 and the dispersed phase inlet 114. The plurality of channels 120, and microfluidic device 100 more generally, can configured in accordance with the designs discussed in PCT Patent Publication no. WO 2017/053678, which is incorporated herein in its entirety for all purposes. The plurality of channels 120 is configured to facilitate flow of the continuous phase fluid and the dispersed phase fluid through channels 120, e.g., from continuous phase inlet 112 and the dispersed phase inlet 114 to the plurality of microdroplet generators 130 and to outlet 116.

Figure 2:
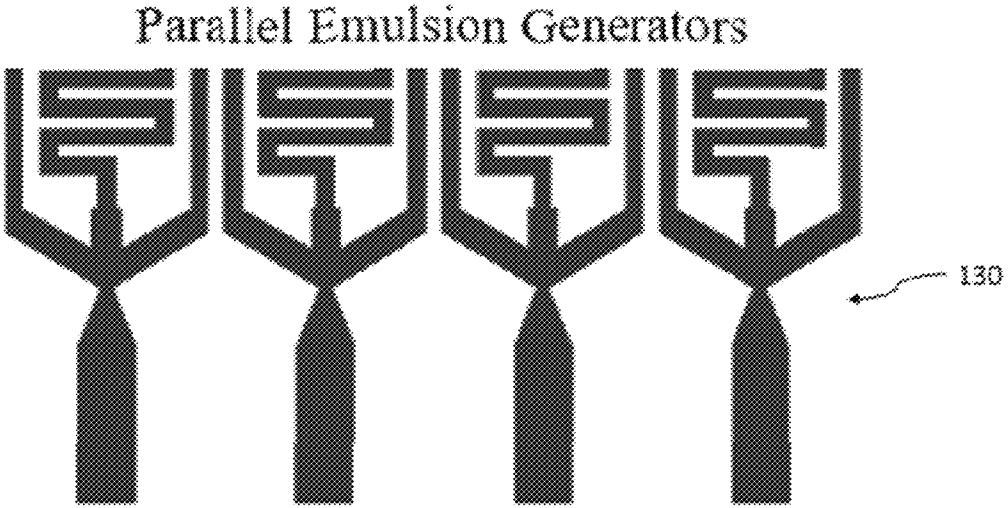
FIG. 2 is a schematic illustration of the microdroplet generators of FIG. 1.

Construct 110 includes a plurality of microdroplet generators 130 configured to produce microdroplets, emulsion droplets, vesicles, microbubbles, or the like. Each of the microdroplet generators 130 is in fluid communication with the plurality of channels. Although microdroplet generators 130 are illustrated as flow focusing droplet makers in FIG. 2, microdroplet generators 130 can comprise any known flow focusing generator geometry. For example, microdroplet generators 130 can be chosen from T-junction droplet makers, Janus particle droplet makers, multiple emulsion droplet makers, and combinations thereof.

In some embodiments, microdroplet generators 130 are all the same type of droplet makers. In another embodiment, microdroplet generators 130 comprise at least two different types of flow focusing generators. In other embodiments, one or more of the microdroplet generators 130 includes an additional fluid inlet (not shown) to create a multiple emulsion microdroplets. Preferably, microfluidic device 100 includes microdroplet generators 130 that are in parallel, e.g., in a ladder configuration, as discussed in PCT Patent Publication no. WO 2017/053678.

Construct 110 of microfluidic device 100 can be formed from perfluoropolyether (hereafter "PFPE") and poly(ethylene glycol) diacrylate (hereafter "PEGDA"). For example, construct 110 can be comprised from a ratio of PFPE to PEGDA of 99.999:0001 to 90:10. Although construct 110 is discussed as having a composition comprising PFPE and a PEGDA, in other embodiments of the invention the construct comprises PFPE and PEG acrylate compounds having more than two acrylate groups or less than two acrylate groups. Additionally, the constructs comprising/formed from PFPE and PEG compounds having two or more or less than two acrylate groups can have the ratios and/or compositions discussed herein with respect to PFPE and PEGDA.

The wettability of construct 110 can be tuned using different proportions of PFPE and PEGDA to form the construct, such as a PFPE to PEGDA ratio of 99.999:0001 to 98:2, 98:2 to 96:4, 96:4 to 94:6, 94:6 to 92:8, or 92:8 to 90:10. Additionally and/or alternatively, the construct can have a composition that comprises at least at least 50% PFPE by weight (e.g., at least 55%; at least 650/oi at least 75%; at least 85%; at least 90%; or at least 95% PFPE; by weight); 10% or less of PEGDA by weight (e.g., g % or less; 8% or less; 7% or less; 6% or less; 5% or less; 4% or less; 3% or less; 2% or less; or 1% or less); and, optionally, one or more comonomers or additives.

Figure 11:
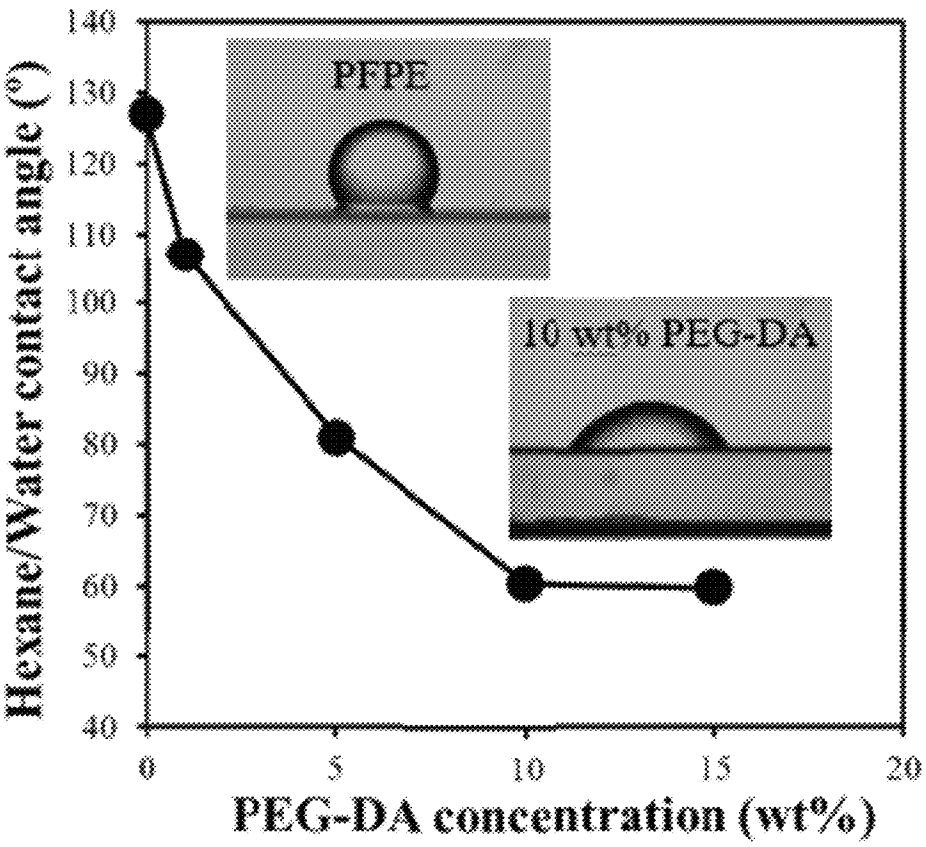
FIG. 11 depicts a graph and images of the hexane/water contact angle of constructs having different ratios of PFPE to PEGDA.

In one embodiment, construct 110 can be formed from solely PFPE or from PFPE and a comonomer that is not PEGDA. Construct 110 can have a proportion of PFPE to PEGDA such that the construct has a hexane/water contact angle ranging from 60° to 90° or from 90° to 130° (see, e.g., FIG. 11).

Figure 12:
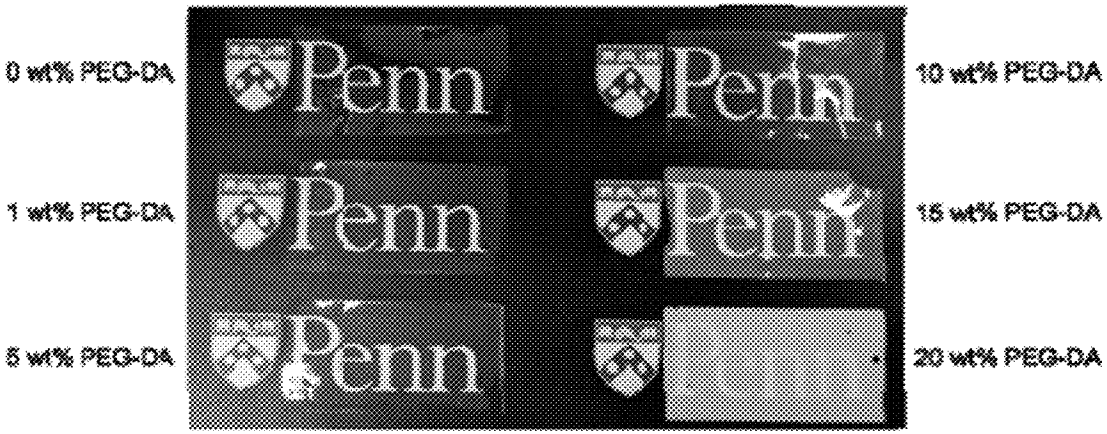
FIG. 12 is an image depicting the transparency of cured polymer networks having different ratios of PFPE to PEGDA.

Construct 110 can be formed as a monolithic single piece or can be formed as two or more pieces. Construct 110 can be configured to be transparent. FIG. 12 illustrates the amount of transparency corresponding to cured polymer networks having different ratios of PIFPE to PEGDA.

Figure 13:
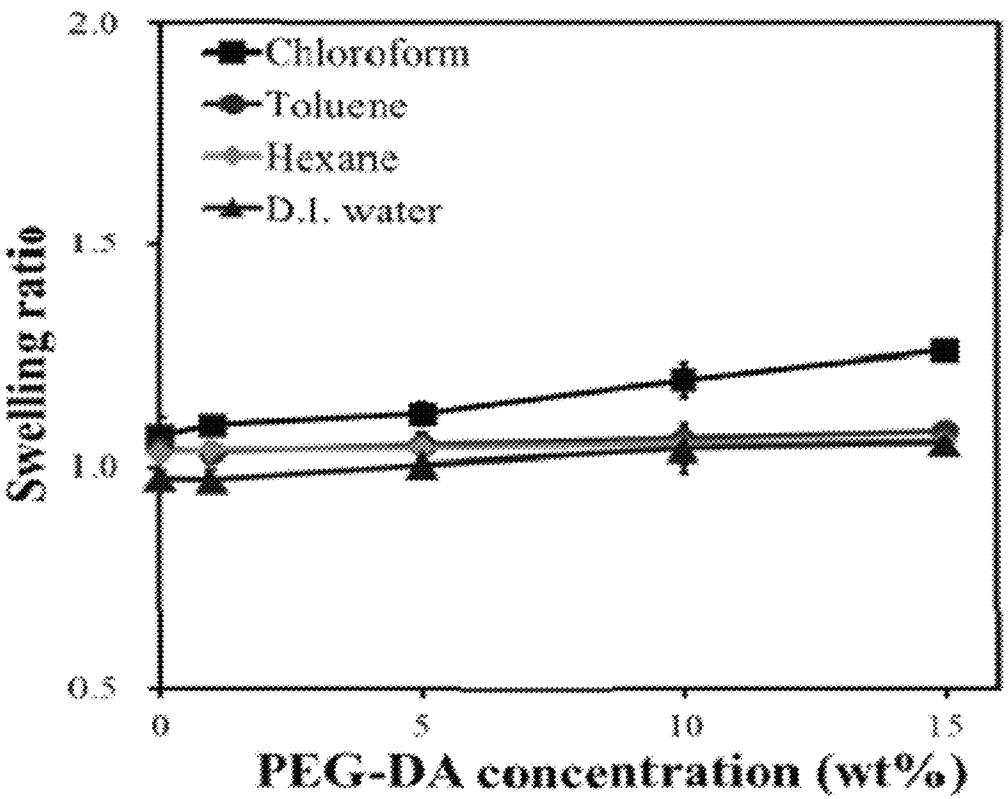
FIG. 13 illustrates a graph of the solvent compatibility of an embodiment of a construct according to aspects of the invention.
Figure 14:
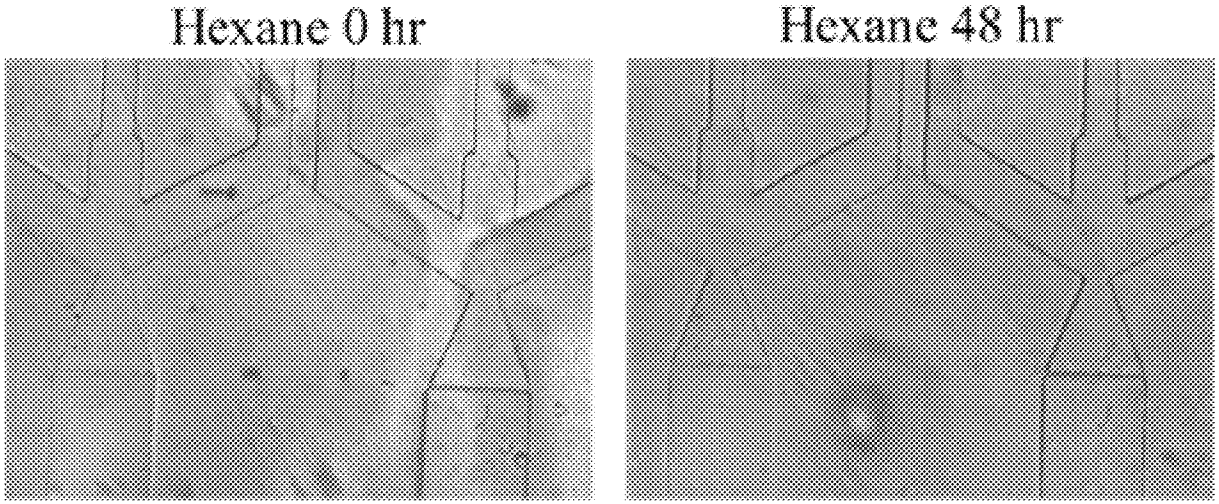
FIG. 14 depicts optical microscope images of a construct comprising 10 wt % PEGDA and 90% PFPE after exposure to hexane in accordance with aspects of the invention.
Figure 15A:
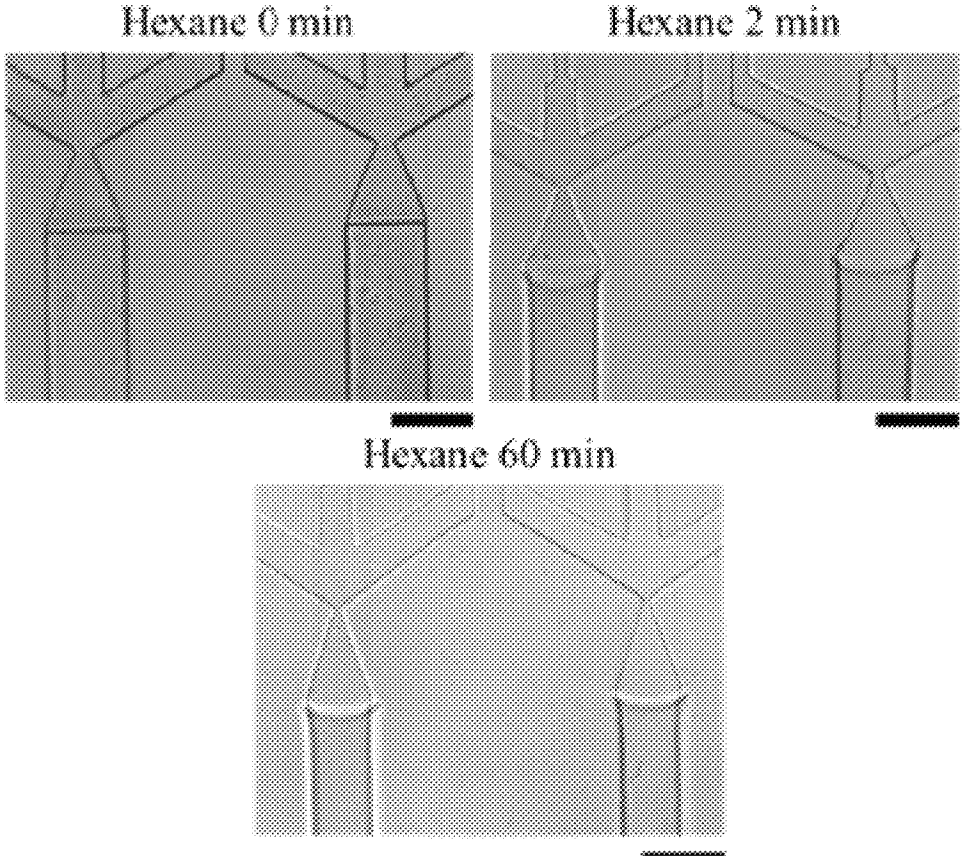
FIG. 15A illustrates optical images of the shrinkage of microchannels of PDMS devices upon exposure to hexane.
Figure 15B:
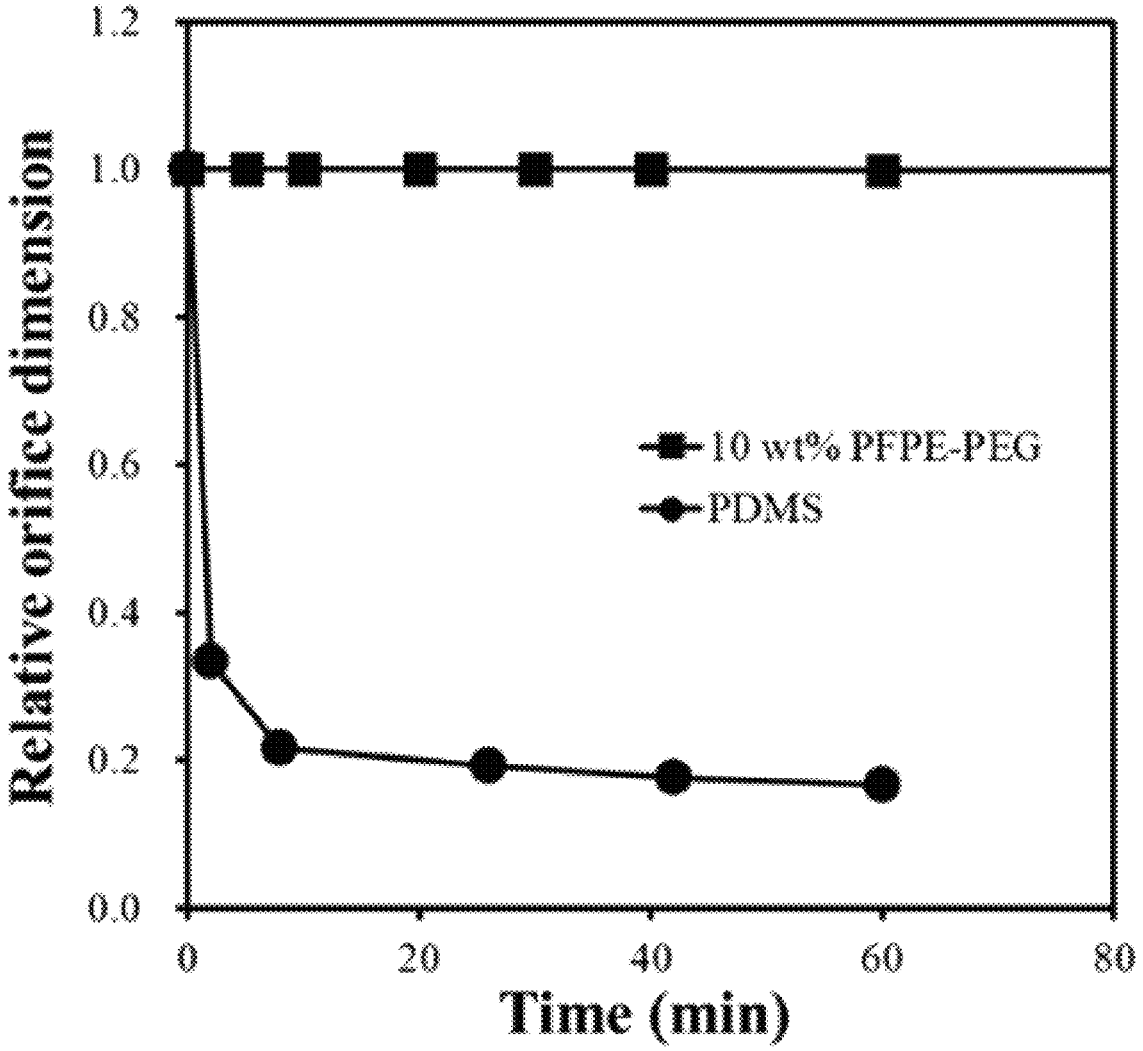
FIG. 15B is a graph depicting the decrease in the size of the orifices of the microchannels of FIG. 16 upon hexane exposure.
Figure 16:
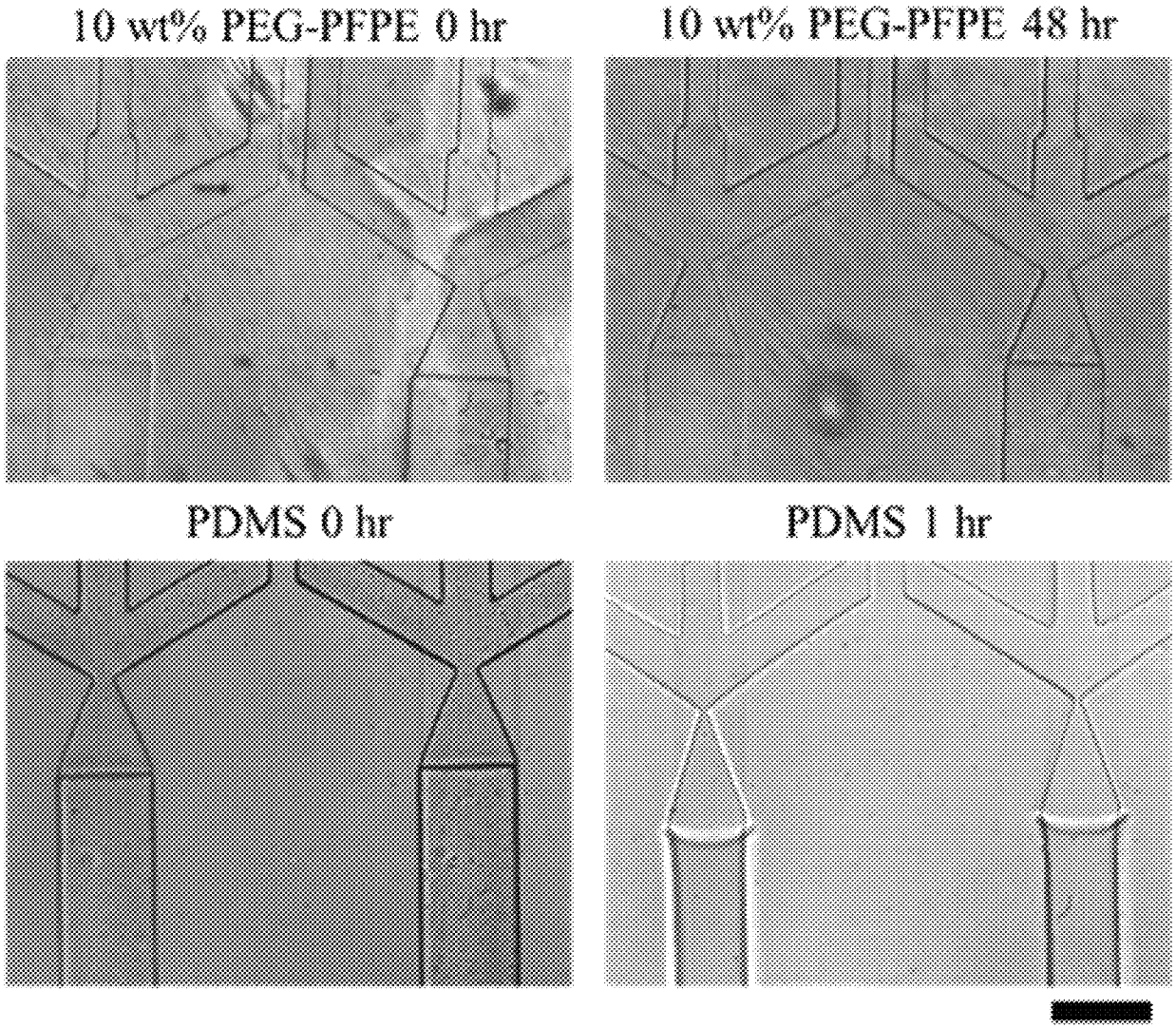
FIG. 16 illustrates the decrease in the size of the orifice width (of the devices in FIG. 16) observed upon hexane exposure as seen in the sudden decrease in the relative orifice size (orifice width after hexane exposure/initial orifice width) after hexane exposure.
Figure 17:
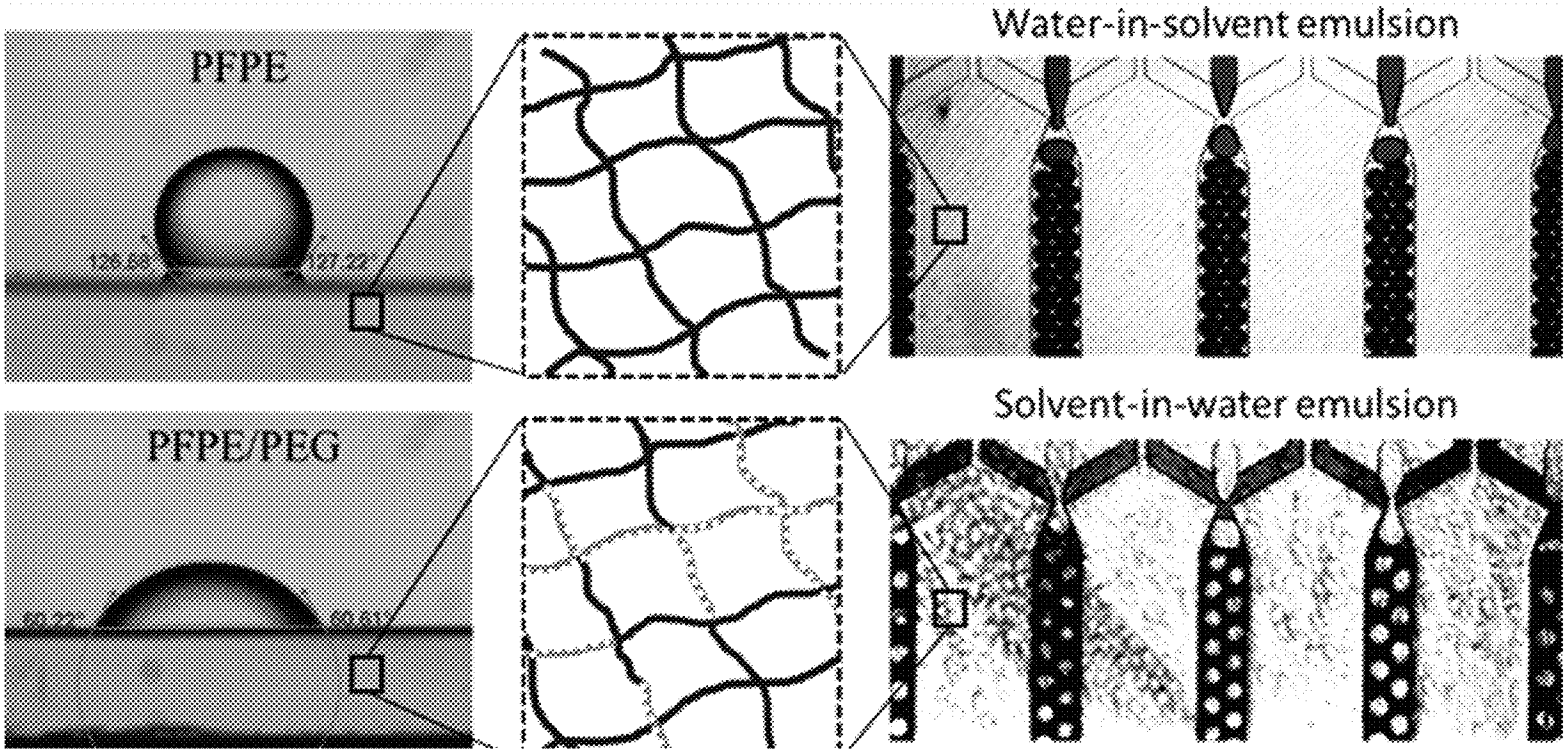
FIG. 17 provides (left panel) exemplary water (in hexane) contact angles for substrates of PFPE and PFPE/PEG composition; (middle panel) representation of the polymer networks shown in the substrates in the left panel of FIG. 17 (dashed lines showing different components of the network), and (right panel) exemplary emulsions formed in devices according to the present disclosure.

Additionally and/or alternatively, construct 110 can be solvent resistant. FIG. 13 illustrates a graph of the solvent compatibility of and embodiment of a construct 110 with chloroform, toluene, hexane, and distilled water.

Figure 3:
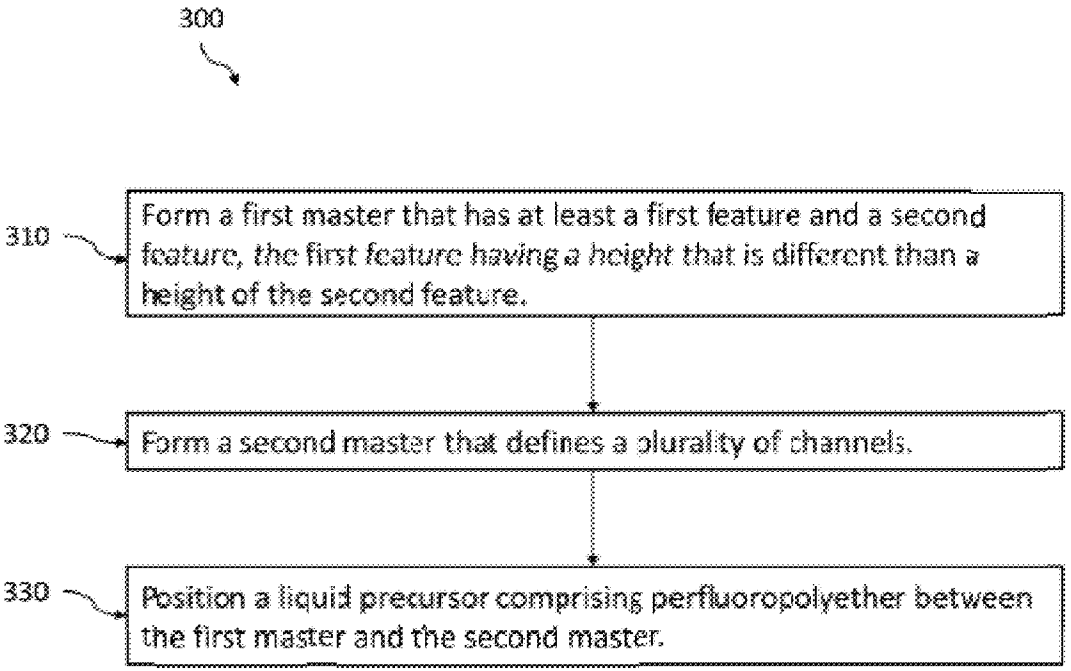
FIG. 3 depicts a first method for manufacturing microfluidic devices configured for generating microdroplets according to aspects of the invention.

FIG. 3 depicts a method 300 for manufacturing microfluidic devices configured for generating microdroplets. As a general overview, method 300 includes forming a first master 410 in step 310, forming a second master 420 in 320, and positioning a liquid precursor between the first master 410 and the second master 420 in step 330.

In step 310, a first master 410 is formed having at least a first feature and a second feature. The first feature has a height that is different than a height of the second feature. The first master 410, which can be the hard master, has at least two features with different heights.

The first master 410 can be formed as monolithic material. Methods for forming the first master 410 include fabrication by sequential photolithography on a silicon wafer. Alternative suitable methods for producing a hard master or a soft master can be employed to form the first master 410 and/or the second master 420.

In step 320, a second master 420 is formed that defines a plurality of channels. The second master 420 can be formed as monolithic material. Methods for forming the second master 420, which can be the soft master, include standard soft lithography techniques. Suitable methods for forming the first master 410, second master 420, and the construct can be found in PCT Patent Publication no. WO 2017/053678, which is incorporated herein in its entirety for any and all purposes.

The first master 410 and the second master 420 can be positioned to form a cavity between the first master 410 and the second master 420. Preferably, the first master 410 and the second master 420 are positioned to define at least one inlet for fluid flow, a plurality of microdroplet generators, a plurality of channels, and at least one outlet. The first master 410 and the second master 420 can be configured to be multi-height and, preferably, reusable.

In step 330, a liquid precursor comprising perfluoropolyether is positioned between the first master 410 and the second master 420. In one embodiment, the liquid precursor mixture with the desired ratio of PFPE and PEGDA is disposed atop the hard master (e.g., the first master 410 or the second master 420), and the soft master (e.g., the other of the first master 410 or the second master 420) is pressed onto the hard master while ensuring alignment between the features of the two masters.

Figure 4:
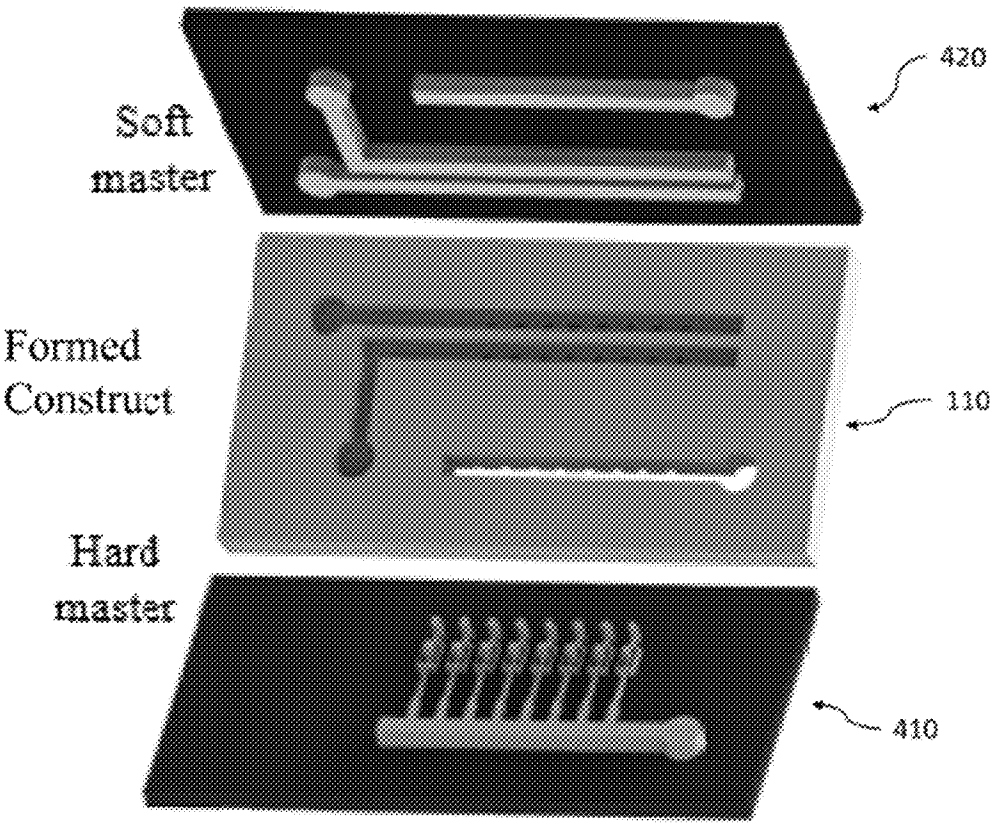
FIG. 4 is a schematic illustration of an embodiment of a soft master, hard master, and the configuration of the construct based on the form of the hard master and soft master in accordance with aspects of the invention.

An illustration of an embodiment of a soft master, hard master, and the configuration of the construct based on the form of the hard master and soft master is provided in FIG. 4. To facilitate the release of the construct after curing from the hard master, the surface of the hard master can be treated with monoglycidyl ether.

Figure 5:
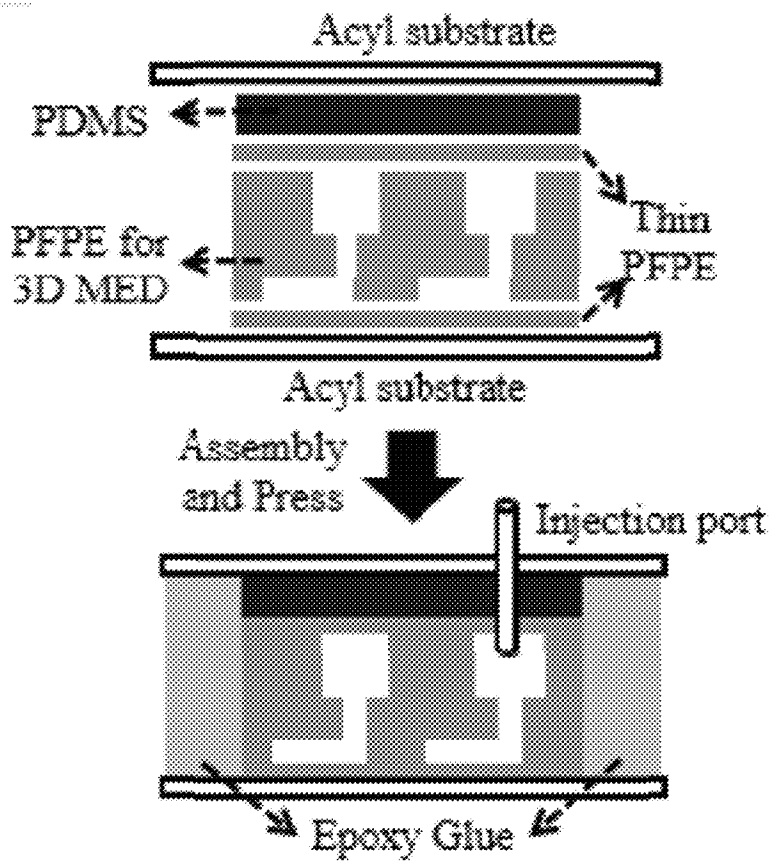
FIG. 5 is a schematic illustration of portions of the first method of FIG. 3.

The first master 410 and the second master 420 can be placed between two plates (e.g., formed of acrylate polymers and/or PFPE), and a sealant (e.g. an epoxy) can be applied to seal the first master 410 and the second master 420 while the two plates are compressed against each other (e.g., as shown in FIG. 5).

The two plates can be compressed against each other using a clamp or other suitable means. To seal the device, a first (e.g., top) plate can be sealed to a first (e.g., top) surface and a second (e.g., bottom) plate can be seal to an opposed second (e.g., bottom) surface. The liquid precursor can be cured using any known suitable means to form the construct and/or produce the microfluidic device.

Figure 6:
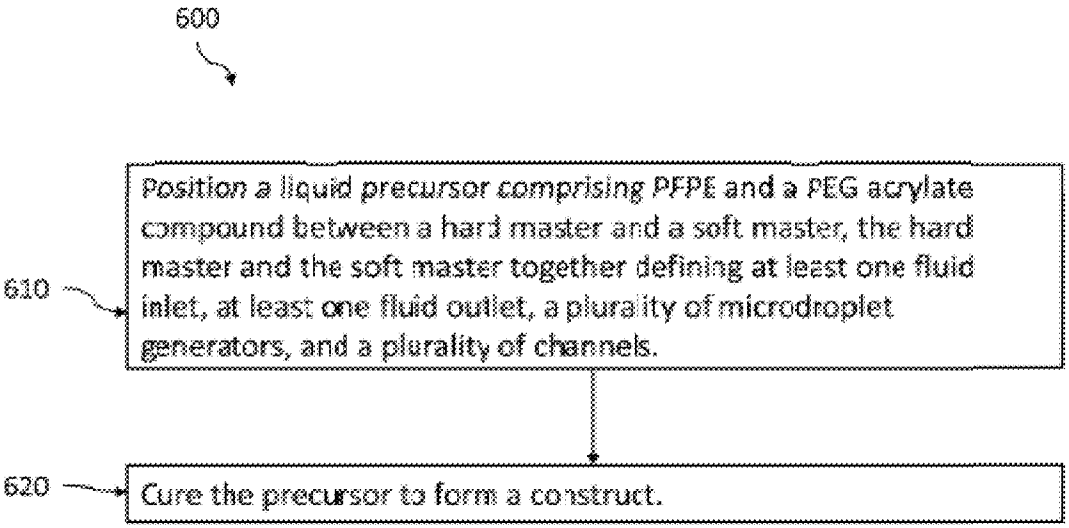
FIG. 6 depicts a second method for manufacturing microfluidic devices configured for generating microdroplets according to aspects of the invention.

FIG. 6 depicts a second method 600 for manufacturing microfluidic devices configured for generating microdroplets. As a general overview, method 600 includes positioning a liquid precursor between a hard master and a soft master in step 610 and curing the precursor in step 620.

In step 610, a liquid precursor comprising PFPE and PEGDA is positioned between a hard master and a soft master. The hard master and the soft master together defining at least one fluid inlet, at least one fluid outlet, a plurality of microdroplet generators, and a plurality of channels.

In step 620, the precursor is cured to form a construct. The liquid precursor can be cured using any known suitable means to form the construct and/or produce the microfluidic device including, e.g., application of heat, UV, or the like.

EXAMPLES

The following examples are non-limiting embodiments of the present invention, included herein to demonstrate the advantageous results obtained from aspects of the present invention.

Example 1

Constructs comprising PFPE and polyethylene glycol (PEG) networks were synthesized by photoinitiated polymerization of PFPE-urethane dimethacrylate (MW~rv 2,000 g/mol) and PEG diacrylate (MW=575 g/mol). PFPE macromonomer has excellent miscibility with photoinitiators and also some hydrogenated acrylates due to the presence of the polar group (i.e., urethane). 2-Hydroxy-2-methylpropiophenone (Darocur 1173) was added to the mixture at 4 wt % as a photoinitiator.

After mixing the two macromonomers and the photoinitiator, the mixture remained clear with no apparent macroscopic phase separations. Irradiation of the thin slab (200 um) of the precursor mixture with 365 nm UV light for 5 min solidification of the macromonomers was induced and an optically transparent solid construct was formed. By increasing the concentration of PEGDA above 15 wt %, opaque constructs were produced.

The hexane/water contact angle under hexane was measured, and it was demonstrated that the wetting property can be varied over a wide range by modifying the composition of the network. In particular, under hexane, PFPE has hexane/water contact angle of ~130°, whereas PFPE with 10 wt % PEG-DA network has a hexane/water contact angle of 60°.

Figure 7:
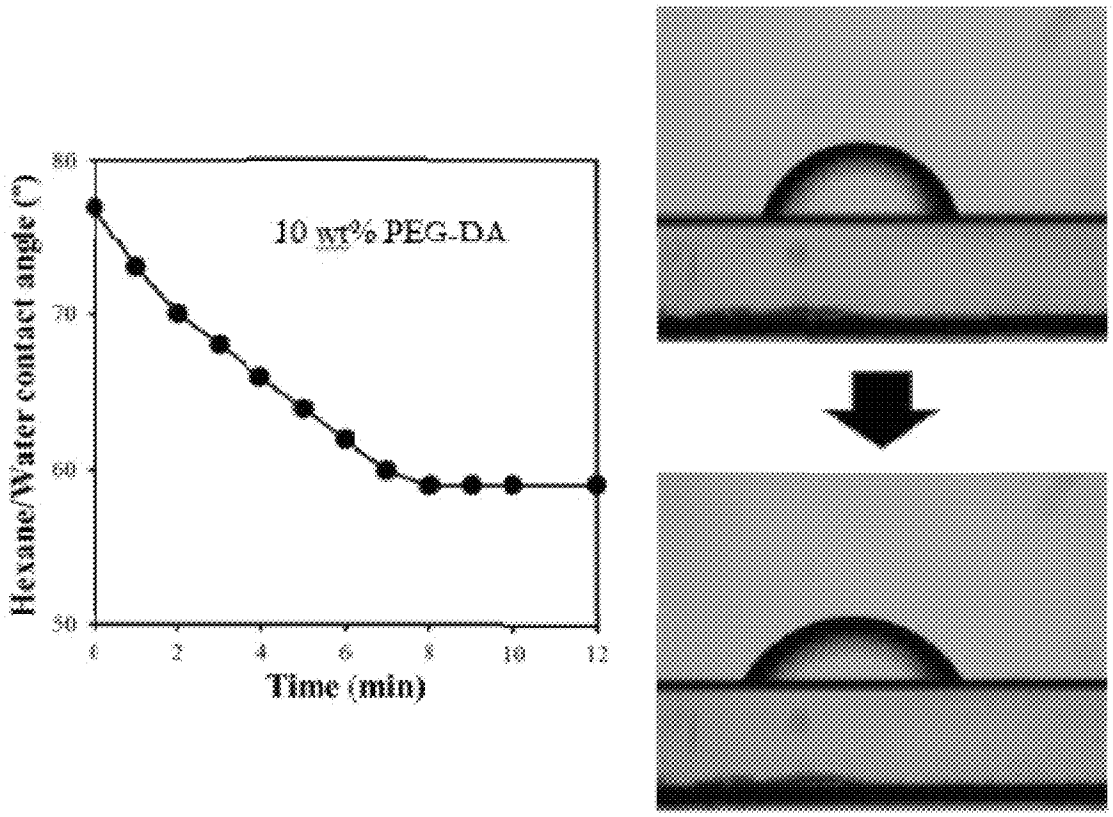
FIG. 7 illustrates a graph of the hexane/water contact of constructs comprising various ratios of PFPE to PEGDA in accordance with aspects of the invention.

The hexane/water contact angle of the surface remained constant once it reaches a plateau value after ~7 min under hexane (FIG. 7). Further, the wetting characteristics of the PFPE and PEG networks network can be varied over a wide range (60-130°) while keeping the material transparent (e.g., the concentration of PEGDA is kept below 10 wt %).

Also unlike polydimethylsiloxane (PDMS) which recovers its hydrophobicity in time after its surface is rendered hydrophilic via surface treatments such as oxygen plasma treatment, a prolonged storage of the PFPE and PEG networks do not induce any changes in the wetting properties of these network, indicating that the two macromonomers have been crosslinked, and the mobility of these species within the network is very low.

Figure 8:
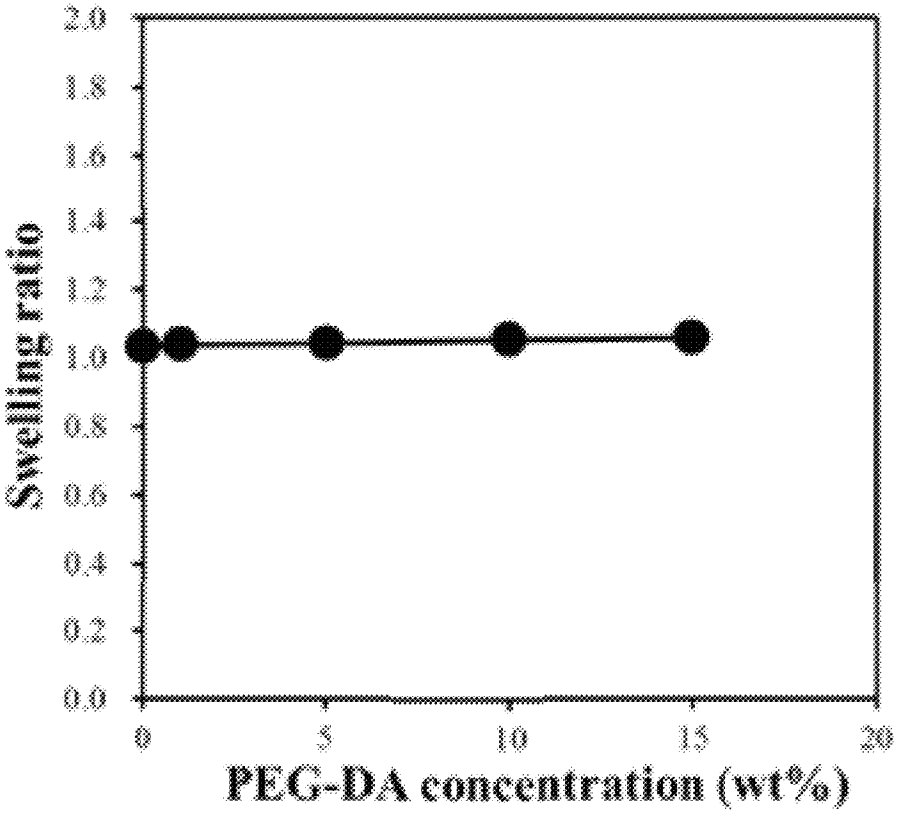
FIG. 8 illustrates a graph of the swelling ratio for constructs comprising PFPE and PEG according to aspects of the invention.
Figure 9A:
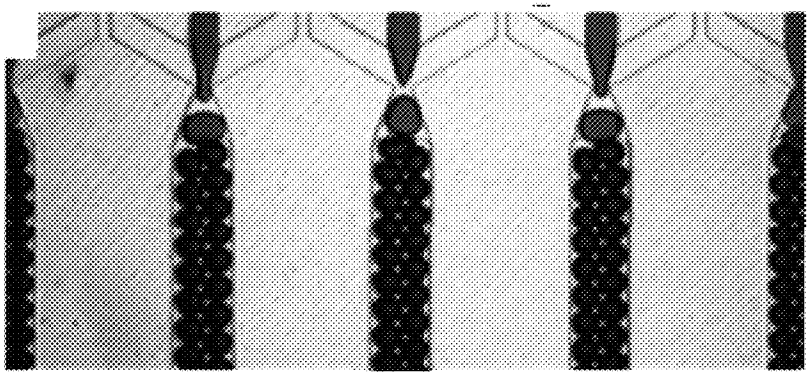
FIGS. 9A-9C are images of microdroplet generators producing microdroplets in accordance with aspects of the invention.
Figure 9B:
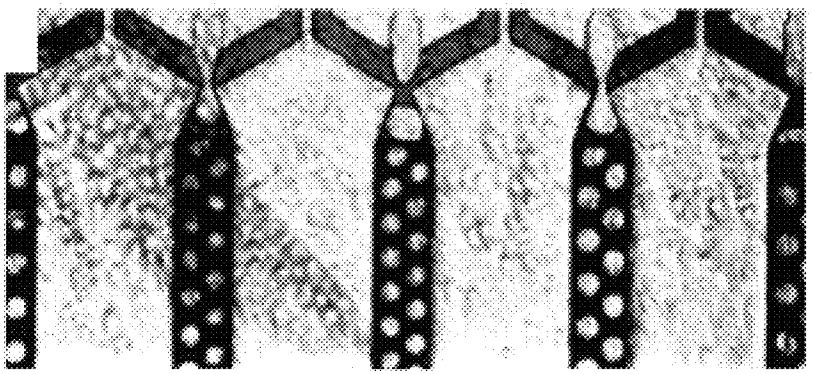
Figure 9D:
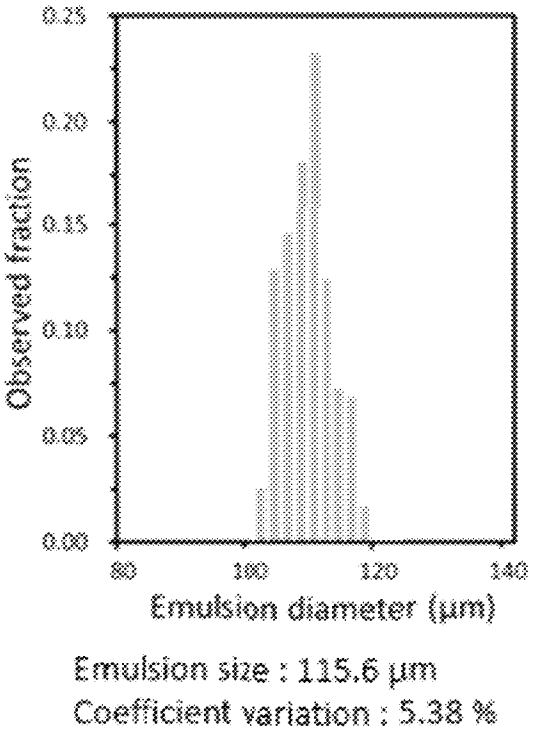
FIG. 9D depicts a graph of the observed diameters of the microdroplet emulsions produced by the microfluidic device(s) partially illustrated in FIGS. 9A-9C.
Figure 9C:
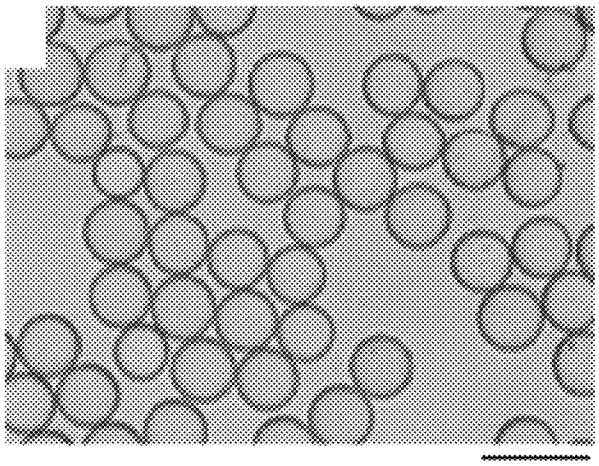
Figure 10B:
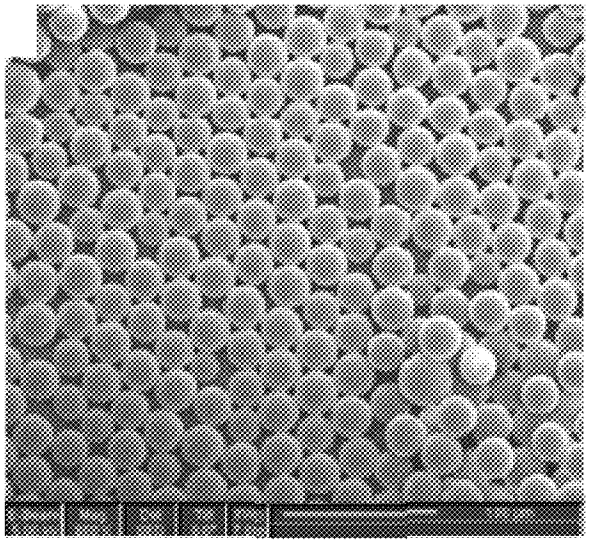
FIGS. 10A and 10B are images of microdroplets produced by microfluidic devices in accordance with aspects of the invention.
Figure 10A:
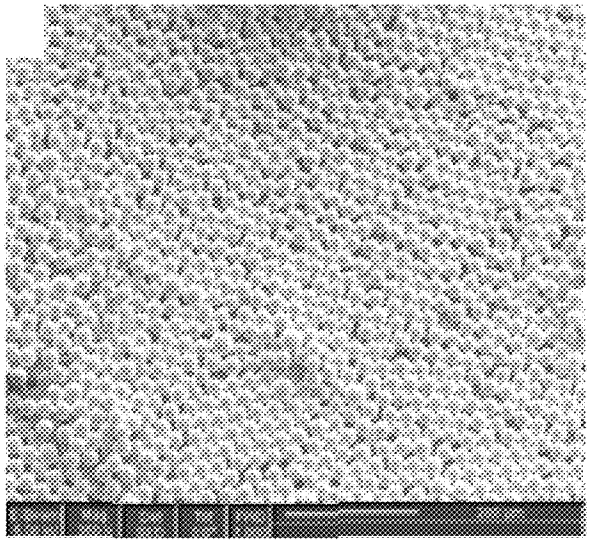
Figure 10C:
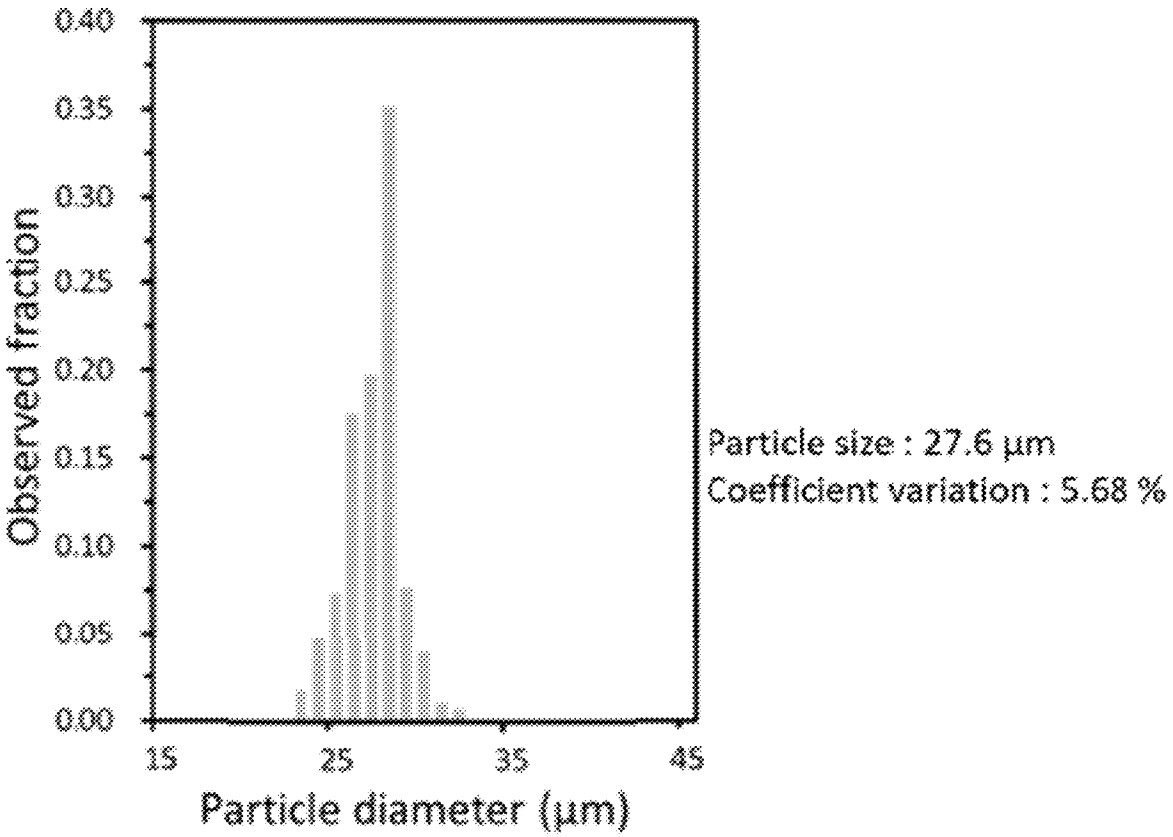
FIG. 10C depicts a graph of the observed diameters of the microdroplet of FIGS. 10A-10B.

The solvent compatibility of the PFPE and PEG network was tested by submerging them in various solvents for 3 days. As can be seen in FIG. 8, PFPE and PEG network networks do not undergo significant swelling in hexane and toluene over all ranges of compositions, indicating that the network is compatible with these solvents.

Networks with high concentrations of PEGDA (e.g., greater than 15 wt %) swell to a small extent (e.g., 25-30%) when they are submerged in chloroform. However, if the wt % of PEGDA is kept below 10 wt %, swelling in chloroform remains relatively small (e.g., less than 10%).

The reported solubility parameters of PFPE (δPFPE) and PEG (δPEG) are about 6 and about 10 $(cal/cm^3)^{1/2}$, respectively. The solubility parameters for hexane, toluene and chloroform, are 7.3, 8.9 and 9.2 respectively. With the exception of chloroform, all these values are sufficiently different from δPFPE and δPEG to make the networks with PFPE-dominant compositions highly compatible with organic solvents.

Example 2

A monolithic microfluidic device was fabricated by double-sided imprinting using a multiheight hard silicon master and a soft PDMS master. To prepare the multi-height hard master, photoresist SU-8 was first spin-coated at 4000 rpm onto a Si wafer (45 μm height). A photomask with patterns for FFGs (100 μm width for dispersed phase channel and 40 μm orifice and 200 μm width for continuous phase channel) and a underpasses for the dispersed phase was used to selectively expose UV onto the spin-coated SU-8.

For the second layer, 600 μm thick SU-8 of is spin-coated atop the first SU-8 layer. A second photomask with through-holes (250 μm diameter) and a collection channel (600 um) was aligned to the first layer using a mask aligner (ABM3000HR) and then exposed to UV. After removing the unexposed regions of the photoresist in the SU-8 develop, the multi-height SU-8 patterns was formed.

To facilitate the removal of the PFPE-PEG 3D MED from the hard master, the master was treated with monoglycidyl ether-terminated PDMS. The hard master was silanized with 0.5 wt % aqueous solution of 3-(aminopropyl triethoxysilane) (APTES) for 10 min after a 3-min $O_2$ plasma treatment. After washing with distilled water, the monoglycidyl ether-terminated PDMS was dropped onto the hard master and incubated at 80° C. for 4 hrs. Subsequently, unreacted PDMS was removed by rinsing with 2-propanol and acetone.

For preparing the PDMS soft master, the conventional single-layer photolithography was employed. SU-8 photoresist was spin-coated onto a silicon wafer and LTV exposed through a photomask and developed to obtain the desired features for delivery and supply channels. The Si masters were silanized with hexamethyldisiloxane. PDMS prepolymer mixed with cross-linker in the ratio of 10:1 was poured onto the Si master with a single-layer SU-8 feature and cured at 95° C. for 2 hours and then peeled off to obtain the PDMS soft master mold.

The PDMS soft master was subsequently silanized with tridecafluoro-1,1,2,2-tetrahydrooctyl-1-trichlorosilane after a 2-min $O_2$ plasma treatment. To fabricate a PFPE-PEG based 3D MED, a mixture with a desired ratio of PFPE and PEG-DA was poured onto both the PDMS soft master mold and the Si hard master.

After removing gas bubbles in a vacuum chamber, the soft and hard masters were aligned with the aid of fiduciary features on the two masters. The PFPE-PEG network between the two masters was polymerized by UV irradiation while the two masters were aligned and brought into contact with each other. The final 3D MED was obtained by peeling off the soft master and the cured PFPE-PEG.

To seal the 3D MED with construct, two thin slabs of PFPE (200 μm) were assembled on the top and bottom of the construct of the microfluidic device and a slab of PDMS (50 mm) on top of PFPE slab. This stack was placed between two hard acrylate plates to apply uniform pressure to the assembled stack. Finally, 5-min epoxy glue was used to maintain the assembled stack while pressure is applied on the top and bottom acrylate plates using a three-prong laboratory clamp.

Injection holes (0.75 mm in diameter) for the fluids were punched through the top PFPE and PDMS slab using a stainless steel punch. A syringe needle (outer diameter=0.92 mm) connected to polyethylene tubing (inner diameter=0.86 mm and outer diameter=1.32 mm) was inserted into the acrylate plate that has laser-cut injection ports.

Example 3

To test parallel emulsion generation using the microfluidic device of Example 2, hexane and 2 wt % SDS aqueous solution was used as the oil and water phases of an oil-in-water (O/W) emulsion, respectively. For W/O emulsion generation, de-ionized water was used as the dispersed phase and a hexadecane solution with 2 wt % Span 80 was used as the continuous phase.

For the formation of polystyrene microparticles, an O/W emulsion was generated using a polystyrene-dissolved hexane solution (10 wt % PS) as the dispersed phase and 2 wt % SDS aqueous solution as the continuous phase in a PFPE-PEG (9:1 ratio) based 3D MED. The O/W emulsions were collected in a container, and the solvent was allowed to evaporate to produce PS solid microparticles.

The diameter of emulsion in the microfluidic channel (Dp) was measured using optical microscopy (Nikon Diaphot 300 Inverted Microscope) and analyzed using ImageJ. The polystyrene microparticles were imaged using a scanning electron microscope (SEM, JEOL 7500F HRSEM).

Example 4

A microfluidic device having a construct comprising a PFPE-PEG network was produced. The microfluidic device enabled the preparation of highly uniform microspheres (e.g., a coefficient variation of greater than 6%) by using a 100-FFG 3D MED and polystyrene solution in hexane at a throughput of 1.34 g/hr.

It has been shown that typical microfluidic devices made with PDMS will deform significantly in contact with hexane due to swelling. However, using the PFPE-PEG network-based 3D MED device made with 10 wt % PEG, oil-in-water emulsions with high uniformity were produced, e.g., as show in FIG. 9. Additionally, by evaporating hexane from oil-water emulsions in open air, microspheres that retain the high uniformity of the parent emulsion were produced in large quantity from the parallelized device.

Uniform water-in-oil emulsion were also produced by using deionized water and hexadecane containing 2 wt % Span 80 as the water and oil phases, respectively.

Example 5

The solvent compatibility of PFPE-PEG network was tested by subjecting a micro fluidic device with a droplet generator orifice to hexane. Very small changes in the dimensions of a PFPE-PEG device (10 wt % PEG) were observed (about 3% decrease in the size of the orifice) after 48 hour exposure to hexane. By contrast, a PDMS device with the same dimension underwent significant swelling; the size of the orifice in this case decreased by 80%.

As provided herein, PFPE-PEG (as but one example of the disclosed technology) is a robust material that can be used for microfluidic applications that use organic solvents, and also the impact of swelling on various operations (including droplet formation) is likely to be minimal.

EXEMPLARY EMBODIMENTS

The following embodiments are exemplary only and do not serve to limit the scope of the present disclosure or the appended claims.

Embodiment 1

A microfluidic device comprising: a construct formed from a perfluoropolyether (IPFPE) and a poly(ethylene glycol) acrylate compound, the construct comprising an inlet formed in the construct for receiving a continuous phase fluid, an inlet formed in the construct for receiving a dispersed phase fluid, a plurality of channels extending through the construct, the plurality of channels in fluid communication with both the inlet of the continuous phase fluid and the inlet of the dispersed phase fluid, a plurality of microdroplet generators configured to produce microdroplets, each of the microdroplet generators in fluid communication with the plurality of channels, and an outlet formed in the construct and in fluid connection with the plurality of microdroplet generators.

Embodiment 2

The microfluidic device of Embodiment 1, wherein the poly(ethylene glycol) acrylate compound is poly(ethylene glycol) diacrylate (PEGDA) and the construct has a ratio of PFPE to PEGDA of 99.999:0001 to 90:10.

Embodiment 3

The microfluidic device of any one of Embodiments 1-2, wherein the poly(ethylene glycol) acrylate compound is poly(ethylene glycol) diacrylate (PEGDA) and the construct has a ratio of PFPE to PEGDA of 99.999:0001 to 98:2.

Embodiment 4

The microfluidic device of any one of Embodiments 1-3, wherein the poly(ethylene glycol) acrylate compound is poly(ethylene glycol) diacrylate (PEGDA) and the construct has a ratio of PFPE to PEGDA of 98:2 to 96:4.

Embodiment 5

The microfluidic device of any one of Embodiments 1-4, wherein the poly(ethylene glycol) acrylate compound is poly(ethylene glycol) diacrylate (PEGDA) and the construct has a ratio of PFPE to PEGDA of 96:4 to 94:6.

Embodiment 6

The microfluidic device of any one of Embodiments 1-5, wherein the poly(ethylene glycol) acrylate compound is poly(ethylene glycol) diacrylate (PEGDA) and the construct has a ratio of PFPE to PEGDA of 94:6 to 92:8.

Embodiment 7

The microfluidic device of any one of Embodiments 1-6, wherein the poly(ethylene glycol) acrylate compound is poly(ethylene glycol) diacrylate (PEGDA) and the construct has a ratio of PFPE to PEGDA of 92:8 to 90:10.

Embodiment 8

The microfluidic device of any one of Embodiments 1-7, wherein the poly(ethylene glycol) acrylate compound is poly(ethylene glycol) diacrylate (PEGDA) and the construct comprises 10% or less of PEGDA.

Embodiment 9

The microfluidic device of any one of Embodiments 1-8, wherein the construct is transparent.

Embodiment 10

The microfluidic device of any one of Embodiments 1-9, wherein the construct has a water contact angle of less than 90° under hexane.

Embodiment 11

The microfluidic device of any one of Embodiments 1-10, wherein the construct has a water contact angle of more than 90° under hexane.

Embodiment 12

A method for producing a microfluidic device comprising: forming a first master that has at least a first feature and a second feature, the first feature having a height that is different than a height of the second feature; forming a second master that defines a plurality of channels; and positioning a liquid precursor comprising perfluoropolyether between the first master and the second master.

Embodiment 13

The method of Embodiment 12, wherein the first master is configured to be a hard master and the second master is configured to be a soft master.

Embodiment 14

The method of Embodiment 13, wherein the hard master is formed by soft lithography technique.

Embodiment 15

The method of Embodiment 13, wherein the soft master is formed by soft lithography technique.

Embodiment 16

The method of Embodiment 13, further comprising treating the surface of the hard master with monoglycidyl ether-terminated polydimethylsiloxane.

Embodiment 17

The method of any one of Embodiments 12-16, further comprising curing the precursor to form a construct.

Embodiment 18

The method of any one of Embodiments 12-17, further comprising sealing a first side of the microfluidic device with a plate and sealing a second side of the microfluidic device with a second plate, the second side of the microfluidic device opposing the first side of the microfluidic device.

Embodiment 19

The method of any one of Embodiments 12-18, wherein the liquid precursor further comprises poly(ethylene glycol) diacrylate.

Embodiment 20

A method for producing a microfluidic device comprising: positioning a liquid precursor comprising perfluoropolyether and a poly(ethylene glycol) acrylate compound between a hard master and a soft master, the hard master and the soft master together defining at least one fluid inlet, at least one fluid outlet, a plurality of microdroplet generators, and a plurality of channels; and curing the precursor to form a construct.

Embodiment 21

A microfluidic device, comprising: a construct comprising a perfluoroether (PFPE) and a poly(ethylene glycol) acrylate (PEGA), the construct comprising one or more first channels formed in the construct, the one or more first channels being configured to receive a first fluid; one or more second channels formed in the construct, the one or more second channels being configured to receive a second fluid; a third channel formed in the construct (though the third channel can optionally be formed in the construct), the third channel configured (i) to receive first fluid from the one or more first channels and (ii) to receive second fluid from the one or more second channels, the third channel optionally being configured to effect under suitable conditions formation of an emulsion between the first fluid and the second fluid.

The first fluid can be a continuous phase fluid or a disperse phase fluid. Likewise, the second fluid can be a continuous phase fluid or a disperse phase fluid. The third channel can be configured as (or as part of) a droplet generator.

Embodiment 22

The microfluidic device of Embodiment 21, wherein the ratio by weight of PFPE to PEGA in the construct is from 99.999:001 to 85:15.

Embodiment 23

The microfluidic device of any one of Embodiments 21-22, wherein the PEGA is poly(ethylene glycol) diacrylate (PEGDA).

Embodiment 24

The microfluidic device of any one of Embodiments 21-23, wherein the emulsion is characterized as an emulsion of the first fluid in the second fluid.

Embodiment 25

The microfluidic device of any one of Embodiments 21-23, wherein the emulsion is characterized as an emulsion of the second fluid in the first fluid.

Embodiment 26

The microfluidic device of any one of Embodiments 21-25, wherein the construct is characterized as essentially transparent.

Embodiment 27

The microfluidic device of any one of Embodiments 21-26, wherein the PFPE and PEGA of the construct are cross-linked with one another.

Embodiment 28

The microfluidic device of any one of Embodiments 21-27, wherein (i) a first channel of the device defines an initial dimension D10 and defines a dimension D11 following construct exposure to hexane for 1 hour, and (ii) wherein D10 is within about 1% of D11.

Embodiment 29

The microfluidic device of any one of Embodiments 21-28, wherein (i) a second channel of the device defines an initial dimension D21 and defines a dimension D22 following construct exposure to hexane for 1 hour, and (ii) wherein D21 is within about 1% of D22.

Embodiment 30

The microfluidic device of any one of Embodiments 21-29, wherein (i) the third channel of the device defines an initial dimension D31 and defines a dimension D32 following construct exposure to hexane for 1 hour, and (ii) wherein D31 is within about 1% of D32.

Embodiment 31

The microfluidic device of any one of Embodiments 21-30, further comprising an aqueous fluid disposed in the one or more first channels or in the one or more second channels.

Embodiment 32

The microfluidic device of any one of Embodiments 21-31, further comprising a non-aqueous fluid disposed in the one or more first channels or in the one or more second channels.

Embodiment 33

The microfluidic device of any one of Embodiments 21-32, further comprising an orifice of the third channel that places the third channel into fluid communication with the one or more first channels and the one or more second channels.

Embodiment 34

A method, comprising: with a device according to any one of Embodiments 21-33, communicating a first fluid though the one or more first channels and communicating a second fluid through the one or more second channels under conditions sufficient to give rise to formation of an emulsion between the first fluid and the second fluid in the third channel.

Embodiment 35

The method of Embodiment 34, wherein the emulsion is characterized as an emulsion of the first fluid in the second fluid.

Embodiment 36

The method of any one of Embodiments 34-35, wherein the emulsion is characterized as an emulsion of the second fluid in the first fluid.

Embodiment 37

The method of any one of Embodiments 34-36, further comprising effecting polymerization within a dispersed phase of the emulsion so as to give rise to polymerized particulates.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A microfluidic device comprising: a construct formed from a perfluoropolyether (PFPE) and a poly(ethylene glycol) acrylate (PEGA) compound, the PEGA compound being present at no more than 10 wt % relative to the PFPE and the construct comprising an inlet formed in the construct for receiving a continuous phase fluid, an inlet formed in the construct for receiving a dispersed phase fluid, a plurality of channels extending through the construct, the plurality of channels in fluid communication with both the inlet of the continuous phase fluid and the inlet of the dispersed phase fluid, a plurality of microdroplet generators configured to produce microdroplets, each of the microdroplet generators in fluid communication with the plurality of channels, and an outlet formed in the construct and in fluid connection with the plurality of microdroplet generators.

2. The microfluidic device of claim 1, wherein the poly (ethylene glycol) acrylate compound is poly(ethylene glycol) diacrylate (PEGDA) and the construct has a ratio of PFPE to PEGDA of 99.999:0.0001 to 90:10.

3. The microfluidic device of claim 1, wherein the poly (ethylene glycol) acrylate compound is poly(ethylene glycol) diacrylate (PEGDA) and the construct has a ratio of PFPE to PEGDA of 99.999:0.0001 to 98:2.

4. The microfluidic device of claim 1, wherein the poly (ethylene glycol) acrylate compound is poly(ethylene glycol) diacrylate (PEGDA) and the construct has a ratio of PFPE to PEGDA of 98:2 to 96:4.

5. The microfluidic device of claim 1, wherein the poly (ethylene glycol) acrylate compound is poly(ethylene glycol) diacrylate (PEGDA) and the construct has a ratio of PFPE to PEGDA of 96:4 to 94:6.

6. The microfluidic device of claim 1, wherein the poly (ethylene glycol) acrylate compound is poly(ethylene glycol) diacrylate (PEGDA) and the construct has a ratio of PFPE to PEGDA of 94:6 to 92:8.

7. The microfluidic device of claim 1, wherein the poly (ethylene glycol) acrylate compound is poly(ethylene glycol) diacrylate (PEGDA) and the construct has a ratio of PFPE to PEGDA of 92:8 to 90:10.

8. The microfluidic device of claim 1, wherein the poly (ethylene glycol) acrylate compound is poly(ethylene glycol) diacrylate (PEGDA) and the construct comprises 10% or less of PEGDA.

9. The microfluidic device of claim 1, wherein the construct is transparent.

10. The microfluidic device of claim 1, wherein the construct has a water contact angle of less than 90° under hexane.

11. The microfluidic device of claim 1, wherein the construct has a water contact angle of more than 90° under hexane.

12. A method for producing a microfluidic device comprising: forming a first master that has at least a first feature and a second feature, the first feature having a height that is different than a height of the second feature; forming a second master that defines a plurality of channels; and positioning a liquid precursor comprising a perfluoropolyether (PFPE) and a poly(ethylene glycol) acrylate (PEGA) compound, the PEGA compound being present at no more than 10 wt % relative to the PFPE between the first master and the second master.

13. The method of claim 12, wherein the first master is configured to be a hard master and the second master is configured to be a soft master.

14. The method of claim 13, wherein the hard master is formed by soft lithography technique.

15. The method of claim 13, wherein the soft master is formed by soft lithography technique.

16. The method of claim 13, further comprising treating the surface of the hard master with monoglycidyl ether-terminated polydimethylsiloxane.

17. The method of claim 12, further comprising curing the precursor to form a construct.

18. The method of claim 17, further comprising sealing a first side of the microfluidic device with a plate and sealing a second side the microfluidic device with a second plate, the second side of the microfluidic device opposing the first side of the microfluidic device.

19. The method of claim 12, wherein the liquid precursor further comprises poly(ethylene glycol) diacrylate.

20. A method for producing a microfluidic device comprising: positioning a liquid precursor comprising a perfluoropolyether (PFPE) and a poly(ethylene glycol) acrylate (PEGA) compound between a hard master and a soft master, the PEGA compound being present in the liquid precursor at no more than 10 wt % relative to the PFPE, the hard master and the soft master together defining at least one fluid inlet, at least one fluid outlet, a plurality of microdroplet generators, and a plurality of channels; and curing the precursor to form a construct.

21. A microfluidic device, comprising: a construct comprising a perfluoroether (PFPE) and a poly(ethylene glycol) acrylate (PEGA) compound, the PEGA compound in the construct being present at no more than 10 wt % relative to the PFPE, the construct comprising one or more first channels formed in the construct, the one or more first channels being configured to receive a first fluid; one or more second channels formed in the construct, the one or more second channels being configured to receive a second fluid; a third channel formed in the construct, the third channel configured (i) to receive first fluid from the one or more first channels and (ii) to receive second fluid from the one or more second channels, the third channel optionally being configured to effect under suitable conditions formation of an emulsion between the first fluid and the second fluid.

22. The microfluidic device of claim 21, wherein the ratio by weight of PFPE to PEGA compound in the construct is from 98:2 to 90:10.

23. The microfluidic device of claim 21, wherein the PEGA compound is poly(ethylene glycol) diacrylate (PEGDA).

24. The microfluidic device of claim 21, wherein the emulsion is characterized as an emulsion of the first fluid in the second fluid.

25. The microfluidic device of claim 21, wherein the emulsion is characterized as an emulsion of the second fluid in the first fluid.

26. The microfluidic device of claim 21, wherein the construct is characterized as essentially transparent.

27. The microfluidic device of claim 21, wherein the PFPE and PEGA compound of the construct are cross-linked with one another.

28. The microfluidic device of claim 21, wherein (i) a first channel of the device defines an initial dimension D10 and defines a dimension D11 following construct exposure to hexane for 1 hour, and (ii) wherein D10 is within about 1% of D11.

29. The microfluidic device of claim 21, wherein (i) a second channel of the device defines an initial dimension D21 and defines a dimension D22 following construct exposure to hexane for 1 hour, and (ii) wherein D21 is within about 1% of D22.

30. The microfluidic device of claim 21, wherein (i) the third channel of the device defines an initial dimension D31 and defines a dimension D32 following construct exposure to hexane for 1 hour, and (ii) wherein D31 is within about 1% of D32.

31. The microfluidic device of claim 21, further comprising an aqueous fluid disposed in the one or more first channels or in the one or more second channels.

32. The microfluidic device of claim 21, further comprising a non-aqueous fluid disposed in the one or more first channels or in the one or more second channels.

33. The microfluidic device of claim 21, further comprising an orifice of the third channel that places the third channel into fluid communication with the one or more first channels and the one or more second channels.

34. A method, comprising: with a device comprising a construct comprising a perfluoroether (PFPE) and a poly (ethylene glycol) acrylate (PEGA) compound, the PEGA compound being present at no more than 10 wt % relative to the PFPE and the construct comprising one or more first channels formed in the construct, the one or more first channels being configured to receive a first fluid; one or more second channels formed the construct, the one or more second channels being configured to receive a second fluid; a third channel formed in the construct, the third channel configured (i) to receive first fluid from the one or more first channels and (ii) to receive second fluid from the one more second channels, the third channel optionally being configured to effect under suitable conditions formation of an emulsion between the first fluid and the second fluid, communicating a first fluid though the one or more first channels and communicating a second fluid through the one or more second channels under conditions sufficient to give rise to formation of an emulsion between the first fluid and the second fluid in the third channel.

35. The method of claim 34, wherein the emulsion is characterized as an emulsion of the first fluid in the second fluid.

36. The method of claim 34, wherein the emulsion is characterized as an emulsion of the second fluid in the first fluid.

37. The method of claim 34, further comprising effecting polymerization within a dispersed phase of the emulsion so as to give rise to polymerized particulates.

* * * * *